United States Patent [19]

Shimizu

[11] Patent Number: 5,012,093

[45] Date of Patent: Apr. 30, 1991

[54] CLEANING DEVICE FOR WIRE ELECTRODE OF CORONA DISCHARGER

[75] Inventor: Tadafumi Shimizu, Osaka, Japan

[73] Assignee: Minolta Camera Co., Ltd., Osaka, Japan

[21] Appl. No.: 399,621

[22] Filed: Aug. 28, 1989

[30] Foreign Application Priority Data

Aug. 29, 1988 [JP] Japan ..... 63-214474
Aug. 29, 1988 [JP] Japan ..... 63-214475
Aug. 29, 1988 [JP] Japan ..... 63-214476

[51] Int. Cl.[5] ..... H01T 19/04

[52] U.S. Cl. ..... 250/324; 361/229; 361/230

[58] Field of Search ..... 250/324, 323, 326; 361/229, 230

[56] References Cited

U.S. PATENT DOCUMENTS

| | | | |
|---|---|---|---|
| 3,842,273 | 10/1974 | Van Buskirk | 250/324 |
| 3,870,883 | 3/1975 | Oagley | 250/324 |
| 3,875,407 | 4/1975 | Hayne | 250/324 |
| 3,891,846 | 6/1975 | Ito | 250/324 |
| 4,038,546 | 7/1977 | Jasimski | 250/324 |
| 4,788,573 | 11/1988 | Nakaoka et al. | 250/324 |
| 4,885,466 | 12/1989 | Koichi et al. | 250/324 |

FOREIGN PATENT DOCUMENTS

| | | |
|---|---|---|
| 53-106054 | 9/1978 | Japan . |
| 59-111656 | 6/1984 | Japan . |
| 59-126261 | 8/1984 | Japan . |
| 60-51563 | 4/1985 | Japan . |
| 61-153052 | 9/1986 | Japan . |
| 61-292654 | 12/1986 | Japan . |
| 62-246079 | 10/1987 | Japan . |
| 62-176854 | 11/1987 | Japan . |
| 62-195157 | 12/1987 | Japan . |
| 62-288865 | 12/1987 | Japan . |

*Primary Examiner*—Bruce C. Anderson

*Attorney, Agent, or Firm*—Willian, Brinks, Olds, Hofer, Gilson & Lione

[57] ABSTRACT

A cleaning devise for wire electrode of corona discharger, for example, for use in electrophoographic image forming apparatus, which automatically cleans the wire electrode by relative movement of the wire electrode and cleaning member adapted to contact the wire electrode. Driving of a motor for the relative movement is temporarily stopped at a predetermined time or in response to occurrence of trouble of the relative movement, and started again, whereby the relative movement starts certainly.

31 Claims, 12 Drawing Sheets

CLEANING DEVICE FOR WIRE ELECTRODE OF CORONA DISCHARGER

BACKGROUND OF THE INVENTION

1. Field of the Invention

The present invention relates to cleaning devices for the wire electrodes of corona dischargers, for example, to a device for cleaning the wire electrode of a corona discharger for use in electrophotographic image forming apparatus.

2. Description of the Related Art

Corona dischargers comprising a discharging wire provided inside a box-shaped shield case longitudinally thereof are usually used in copying machines and printers adapted to practice an electrophotographic process. The corona discharger serves as a charger for sensitizing the surface of a photosensitive member or as a transfer charger for transferring toner images formed on the photosensitive member to copy paper.

Usually, a high voltage of one thousand, several hundred volts to thousands of volts is applied to the discharger to effect corona discharge to give a uniform charge to the surface of the photosensitive member or copy paper.

However, when the corona discharger is used for a long period of time, silica or toner particles adhere to the wire to result in altered discharging characteristics, so that the discharger fails to charge the photosensitive member or copy paper efficiently and uniformly.

Especially when the discharger is used as a sensitizing charger, variations in the photosensitive member charging characteristics entail varying image densities, while uneven charging produces irregularities, spots and the like in copy images.

To preclude such adverse effects, it has been conventional practice for the serviceman to remove the adhering particles from the wire by periodic cleaning. The corona discharger therefore requires much labor and a substantial cost for maintenance.

Devices for automatically cleaning the wire are available which comprise a cleaning member (cleaner pad) disposed inside the corona discharger and reciprocatingly movable by the rotation of a motor through a pulley and a drive rope. Such a device is disclosed, for example, in Japanese Laid-Open Patent Application No. 53-106054.

However, the conventional wire cleaning device is not always operable with good stability since the drive force is frictionally transmitted from the pulley to the drive rope. Depending on the state of contact between the pulley and the rope, tautness of the drive rope or the condition of the cleaning member as a load, the pulley, if rotated, fails to move the rope with the rotation owing to slippage therebetween. Troubles are therefore likely to occur; the cleaning member will fail to start traveling from its standby position (home position) or will stop during travel.

Further depending on the state of contact between the pulley and the drive rope, the tension on the rope, the condition under which the cleaning member as a load is held, and the surface state of the wire, the motor will be subjected to an excessive loading torque greater than its output, consequently failing to start up or coming to a halt during rotation. Accordingly, the above-mentioned unstable factors are likely to entail the trouble that the cleaning member is unable to start traveling from the home position or comes to a stop during travel.

The cleaning member is heavily loaded by coming into contact with a member provided at the end of range of its travel, whereby the drive force transmitting portion is brought into a locked state. The above trouble is therefore very likely to occur since an especially great drive force is needed to unlock the transmitting portion and release the cleaning member from the end member.

Furthermore, the use of the corona discharger in an apparatus for practicing the electrophotographic process imposes great limitations on its size and configuration, with the result that it is dimensionally difficult to provide drive means which is operable free of an excessive load.

If the above-mentioned trouble occurs, the corona discharger can not be used for the contemplated purpose, and there arises a need for the serviceman to repair the cleaning device. This reduces the operation efficiency of the copying machine or printer incorporating the discharger.

With the wire cleaning device disclosed in the aforementioned publication, the cleaning member is merely formed with a bore for passing the wire therethrough and is accordingly low in the pressure of contact with the wire. Thus, there is a likelihood that the wire will not be fully cleaned.

The device has another problem. The cleaning device, which is in contact with the wire even at the home position, impairs the wire positioning precision, exerts an adverse influence on the discharging characteristics of the wire and deteriorates early by being affected by corona discharge.

In view of the above problem, Japanese Laid-Open Utility Model Application No. 61-153052 discloses a device which comprises a pair of cleaning members movable along a corona wire while holding the wire therebetween to clean the wire.

With this device, the pair of cleaning members are biased into holding contact with the wire by a spring during movement and adapted to come into engagement with an engaging member on the discharger casing to release the wire upon reaching the end of the wire.

Nevertheless, the device has the problem of being complex in construction because the spring is used for pressing the cleaning members into contact with the corona wire and being large sized because the spring must be powerful to give a high contact pressure. The device has another problem in that the spring fatigues during a long period of use to give a lower contact pressure.

SUMMARY OF THE INVENTION

A first object of the present invention is to provide an improved device for cleaning the wire electrode of a corona discharger.

A second object of the invention is to provide a device which is adapted to automatically clean the wire electrode of a corona discharger and in which even when slippage occurs between a pulley and a drive rope or between other members of power transmission means, the slippage can be eliminated automatically for the proper transmission of the drive force to preclude the possible trouble.

A third object of the invention is to provide a corona discharger wire cleaning device wherein even when the drive means thereof is heavily loaded owing to the state of the cleaning member or other member, the drive means is operable without stopping to preclude occurrence of trouble.

A fourth object of the invention is to provide a corona discharger wire cleaning device wherein the cleaning member can be held in contact with the wire by increased pressure to fully clean the wire although the device is compact and simple in construction.

The first and second objects of the invention can be fulfilled by a cleaning device comprising:

a wire electrode extending straight for effecting corona discharge, a cleaning member adapted to contact the wire electrode for cleaning the wire electrode, drive means for moving the wire electrode and the cleaning member relative to each other, and control means for operating the drive means intermittently.

Further the first and third objects of the invention can be fulfilled by a cleaning device comprising:

a wire electrode extending straight for effecting corona discharge, a cleaning member adapted to contact the wire electrode for cleaning the wire electrode, a pair of pulleys for traveling the wire electrode or a rope for driving the cleaning member to move the wire electrode and the cleaning member relative to each other, drive means for drivingly rotating the pulleys, and control means for controlling the drive means so as to automatically change the drive output of the drive means.

Further the first and fourth objects of the invention can be fulfilled by a cleaning device comprising:

a main casing for supporting a corona electrode extending straight for effecting corona discharge, a pair of pulleys disposed at the respective ends of the main casing, a drive rope reeved around the pair of pulleys, a traveling member connected to the drive rope, a support member connected to the traveling member by a pivot and pivotally movable about the pivot, a first cleaning member attached to the support member and movable into pressing contact with the wire electrode by the pivotal movement of the support member, and a second cleaning member secured to the traveling member and opposed to the first cleaning member with the wire electrode positioned between the first and second cleaning members, the support member being pivotally movable by the tension on the drive rope, whereby the first cleaning member is pressed into contact with the wire electrode for the first and second cleaning members to hold the wire electrode therebetween.

BRIEF DESCRIPTION OF THE DRAWINGS

The above and other objects or features of the present invention will become apparent from the following description of preferred embodiments thereof taken in conjunction with the accompanying drawings, in which.

Figure 6:
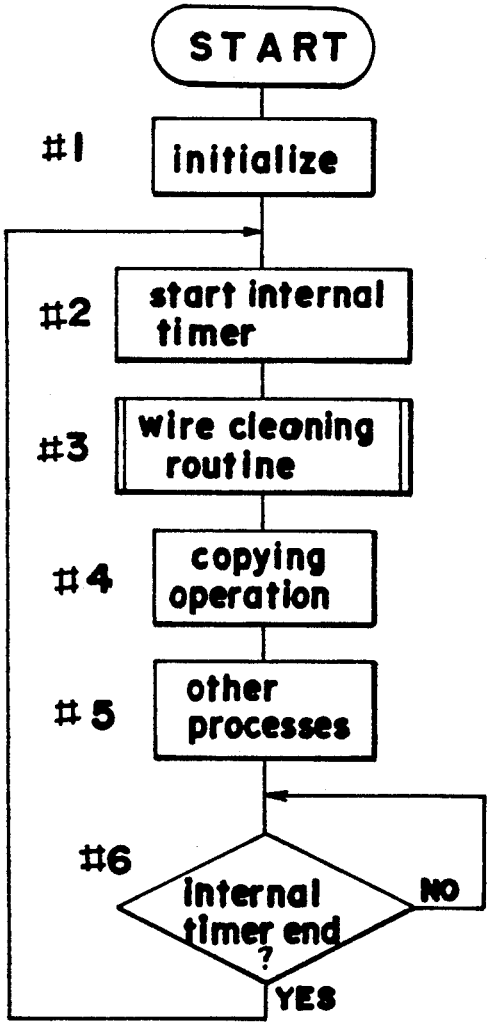
FIG. 6 is a main flow chart generally showing the operation of the copying machine including the corona discharger of the invention.
Figure 7A:
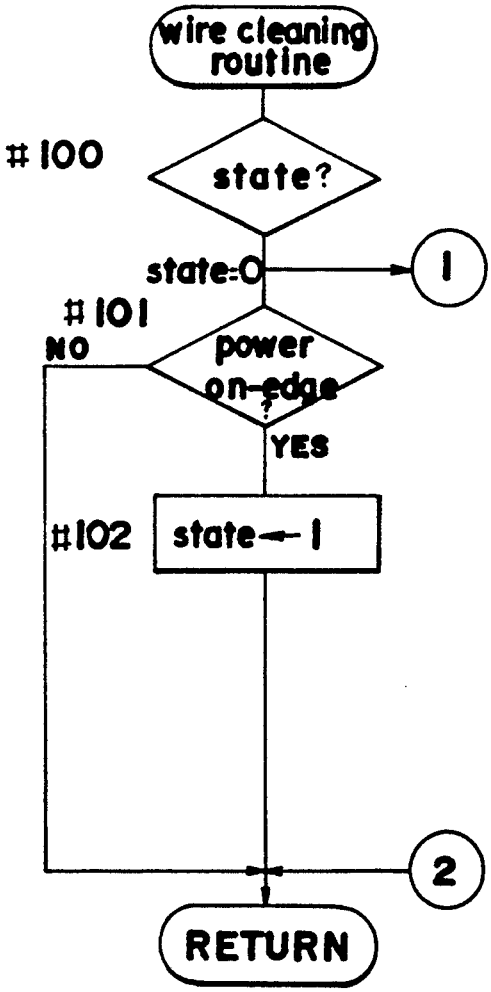
Figure 7B:
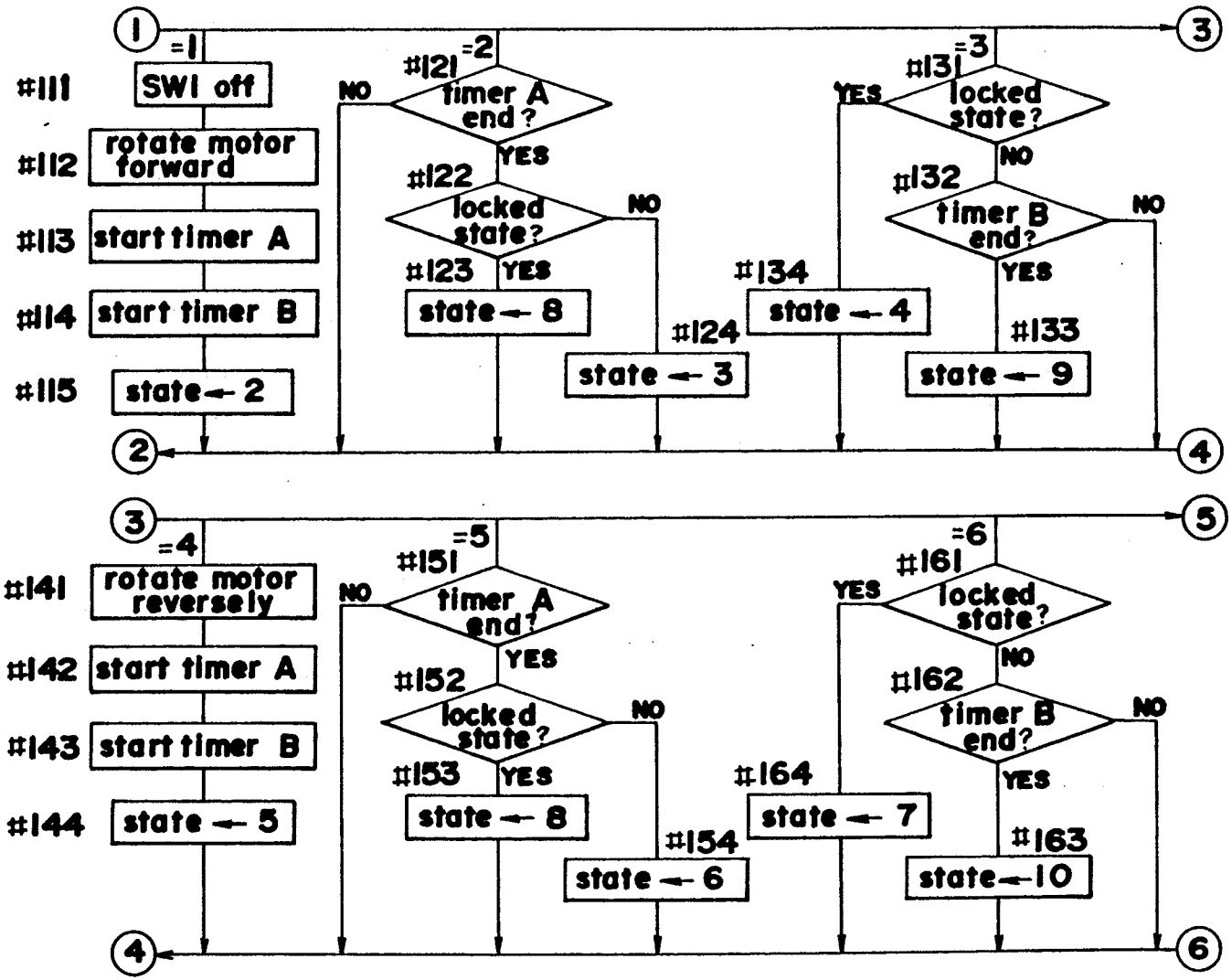
Figure 7C:
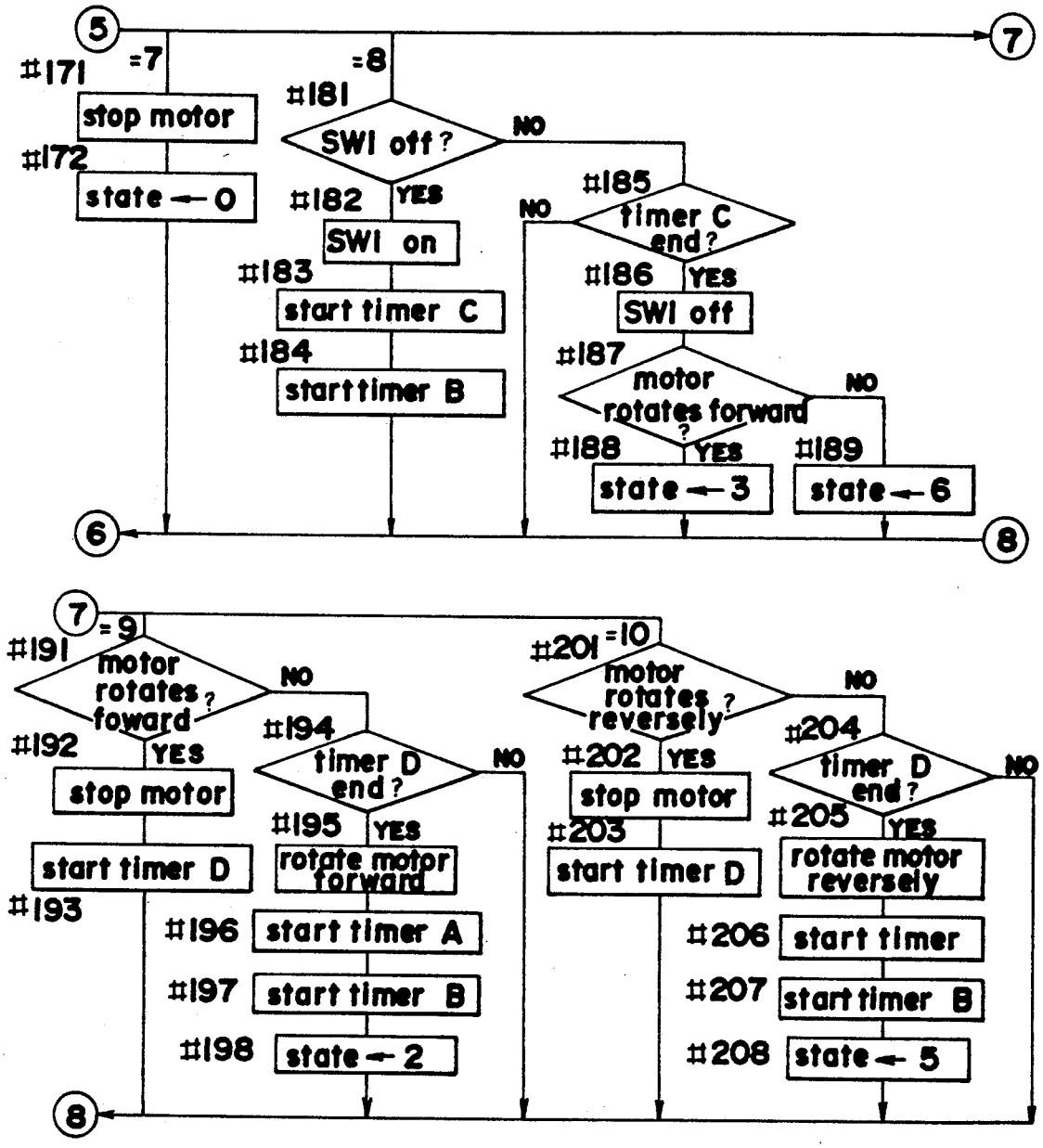
Figure 10:
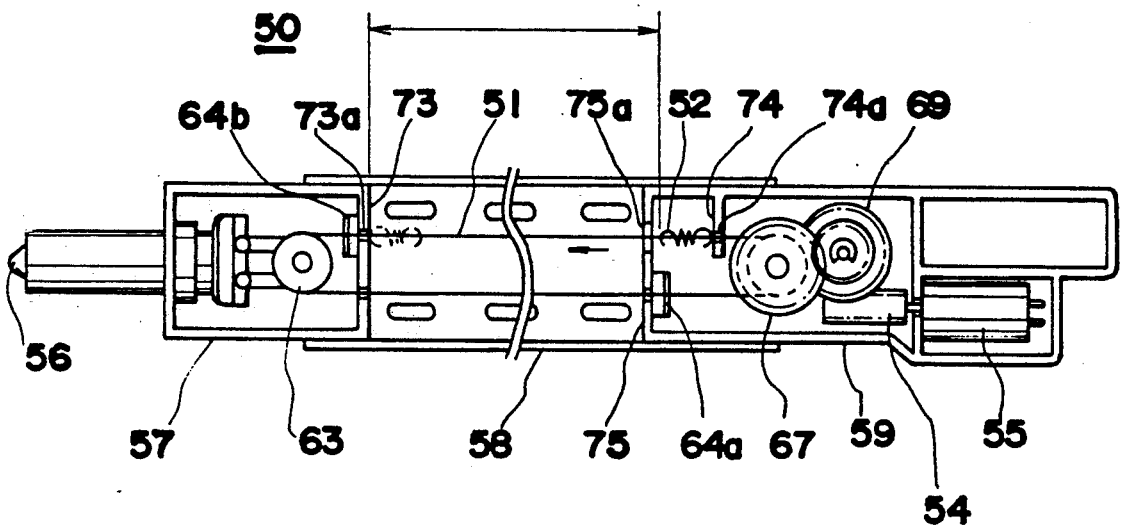
Figure 11:
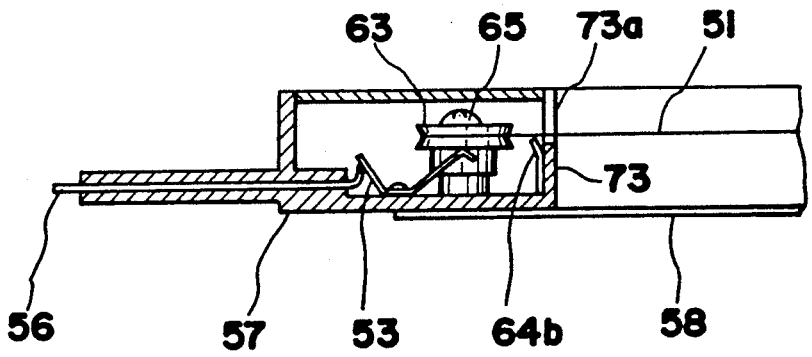
Figure 12:
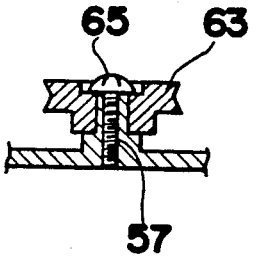
Figure 13:
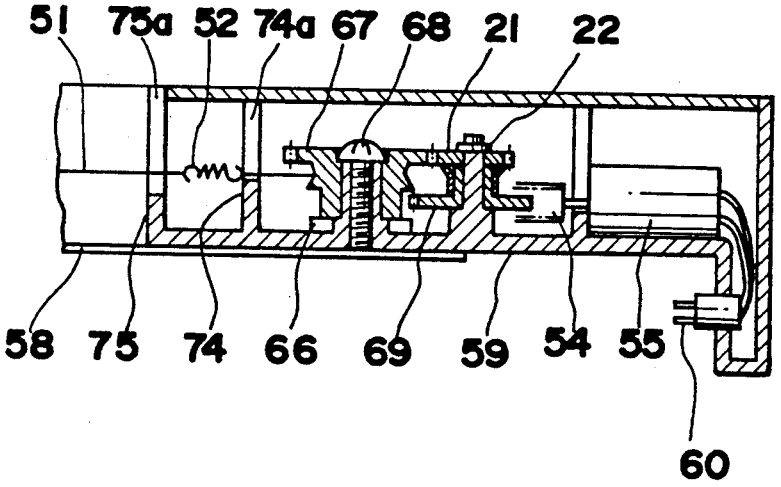
Figure 14:
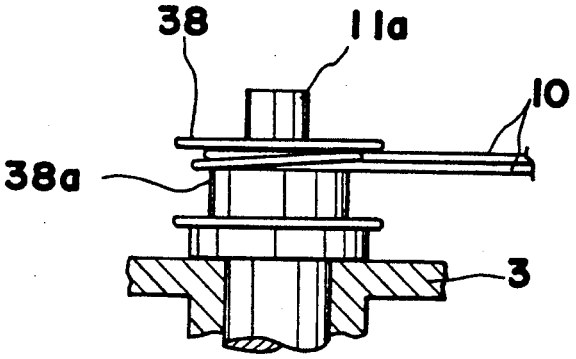
FIG.14 PRIOR ART

FIGS. *7a* to *7c* are flow charts showing the wire cleaning routine of FIG. 6;

FIGS. *8a* and *8b*, and FIGS. *9a* and *9b* are flow charts showing wire cleaning routines according to other embodiments;

FIG. 10 is a plan view of another corona discharger embodying the invention;

FIGS. 11 to 13 are enlarged fragmentary front views in section showing the corona discharger of FIG. 10; and FIG. 14 is a front view of a conventional drive pulley.

In the following description, like parts are designated by like reference numbers throughout the several drawings.

DESCRIPTION OF THE PREFERRED EMBODIMENTS

Figure 1:
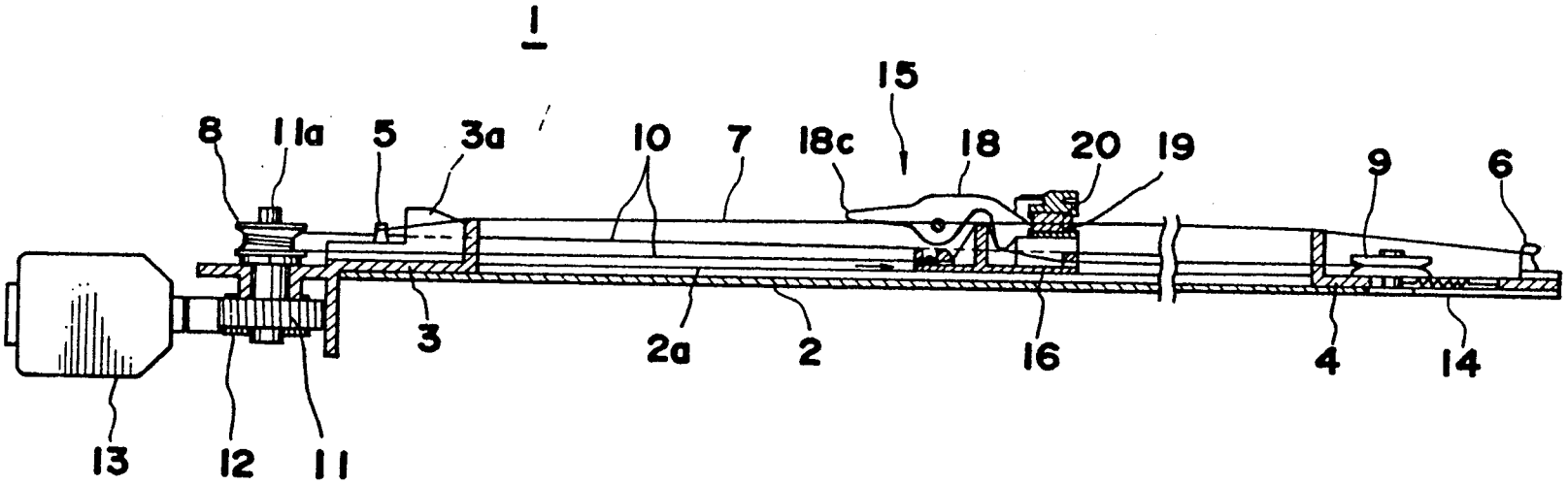
FIG. 1 is a front view of a corona discharger embodying the invention.

FIG. 1 is a front view of a corona discharger 1.

The corona discharger 1 comprises an elongated box-shaped shield case 2 (a major portion of the case 2 is not shown in FIG. 1) made of a metal plate and having an open top side (at the upper side of FIG. 1), holders 3, 4 attached to the respective ends of the shield case 2, a corona wire 7 extending between fastening pins 5, 6 attached to the holders 3, 4, respectively, a drive pulley 8 rotatably mounted on the holder 3, a driven pulley 9 having a shaft mounted on the holder 4 and movable laterally in FIG. 1 (longitudinally of the case 2), a drive rope 10 reeved around the drive pulley 8 and the driven pulley 9, a gear 11 mounted on the same shaft 11*a* as the drive pulley 8 and rotatable therewith, a reversible d.c. motor 13 for drivingly rotating a worm 12 in mesh with the gear 11, a tension spring 14 for pulling the driven pulley 9 in a direction to tension the drive rope 10, and a traveling member 15 movable rightward and leftward in FIG. 1 along a rail 2*a* on the shield case 2.

The fastening pin 6 serves also as an electrode terminal, to which a voltage required for corona discharge is applied by an unillustrated high-voltage transformer. The holder 3 has a land member 3*a* for a bearing portion 18*c* of a support member 18 to ride on as will be described later.

Figure 4:
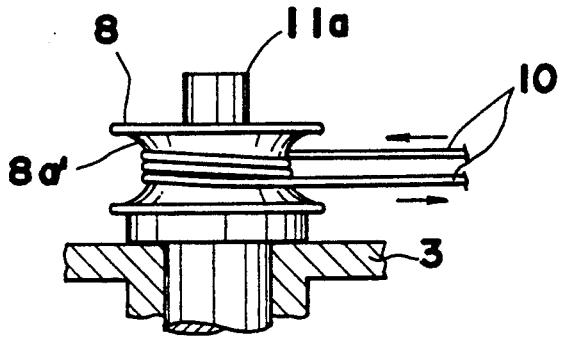
FIG. 4 is an enlarged front view showing a drive pulley and the neighborhood thereof.

FIG. 4 is an enlarged front view showing the drive pulley 8 and the neighborhood thereof.

The drive pulley 8 is made of a rubber material, such as urethane foam, having a great coefficient of friction. The pulley 8 has a U-shaped groove 8*a*′ and the smallest diameter at the center of the groove. The drive rope 10 is wound around the pulley 8 three turns in the groove 8*a*′.

With reference to FIG. 14 showing a conventional drive pulley 38, the groove 38*a* of the pulley is cylindrical and has a bottom defined by a flat surface, consequently permitting the drive rope 10 to overlap itself and therefore giving rise to problems.

For example, the overlapping of the drive rope 10 entails the problem of fluctuating loads. Generally, motors for use in wire cleaning devices such as the one provided by the invention are operable with a small torque and are forced to stop when heavily loaded. Fluctuating loads on the motor in rotation further produce variations in the speed of its rotation and noises. Whereas the present embodiment is so adapted that the arrival of the traveling member 15 at the end of the path of its travel is detected by detecting an eddy current generated under an increased load, a detection error is likely to occur owing to an increased load due to the overlapping of the drive rope 10.

The overlapping of the drive rope 10 raises another problem in that the rope 10 slips relative to the drive pulley 38 because the area of contact therebetween diminishes if the drive rope 10 laps over itself. Improper power transmission will then result.

With the drive pulley 8 of the present embodiment, however, the groove 8*a*', which is U-shaped, obviates the likelihood that the rope 10 will overlap itself when wound on the grooved portion 8*a*' by the rotation of the drive pulley 8. Consequently, the motor 13 is operable free of fluctuations of load, overloading or noise for proper power transmission.

Figure 2:
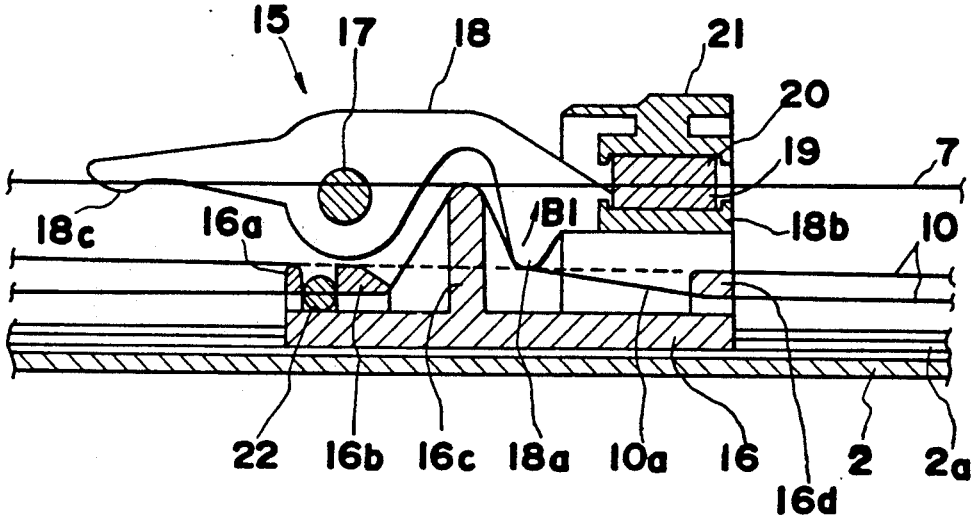
FIGS. 2 and 3 are front views showing a traveling member of the corona discharger on an enlarged scale.
Figure 3:
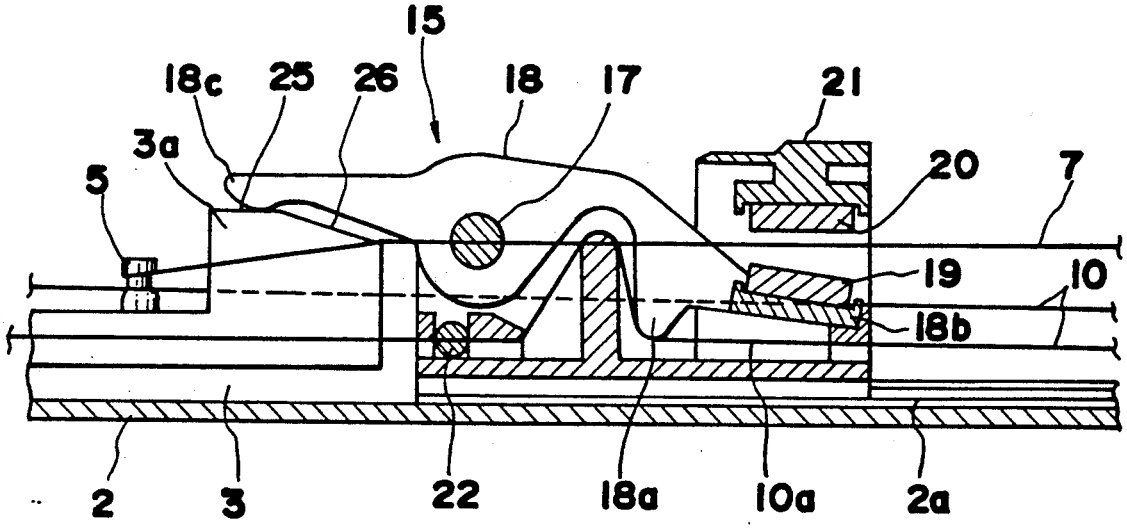

FIGS. 2 and 3 are enlarged front views showing the traveling member 15. FIG. 2 shows the traveling member 15 during travel, while FIG. 3 shows the member 15 at its home position (left-end position in FIG. 1).

Referring to FIG. 2, the traveling member 15 comprises a base member 16, a support member 18 mounted by a pivot 17 on the base member 16 and movable about the pivot 17, a first cleaning member 19 attached to a support portion 18*b* at the forward end of the support member 18 and movable into pressing contact with the wire 7 by the pivotal movement of the support member 18, and a second cleaning member 20 attached to a bracket 21 on the base member 16 and positioned as opposed to the first cleaning member 19.

The base member 16 has restraining portions 16*a* to 16*d*. One side portion 10*a* of the loop of drive rope 10 extends beneath the restraining portions 16*a*, 16*b* and 16*d* and over the restraining portion 16*c*.

Between the restraining portions 16*a*, 16*b*, a restraining member 22 is secured to the drive rope 10, whereby the base member 16 is connected to the drive rope 10 and is made movable therewith. Between the restraining portions 16*c*, 16*d*, an engaging portion 18*a* formed on the support member 18 bears on the drive rope portion 10*a* from above. The drive rope 10 in turn pushes the engaging portion 18*a* upward in the direction of arrow B1 with its tension, pressing the first cleaning member 19 into contact with the wire 7 and the second cleaning member 20 from below.

The support member 18 has the aforementioned bearing portion 18*c* for rotating the support member 18 clockwise in FIG. 2 at the home position (left-end position in FIG. 1) of the traveling member 15 to thereby move the first cleaning member 19 out of pressing contact with the wire 7.

With reference to FIG. 3, the bearing portion 18*c* bears on a top portion 25 of a land member 3*a* after moving along a slanting portion 26 of the land member 3*a*. The support member 18 in the state shown in FIG. 2 moves clockwise about the pivot 17 against the tension on the drive rope 10 when the bearing portion 18*c* thus rides on the top portion 25, thereby moving the first cleaning member 19 away from the wire 7 and the second cleaning member 20.

This releases the wire 7 from the first and second cleaning members 19 and 20 to a free state, permitting the wire 7 to return to the original position as stretched.

Among the components described above, the drive rope 10, the traveling member 15, etc. which will influence the corona discharge by the wire 7 are made of an insulating material such as synthetic resin or synthetic rubber. Suitable materials such as synthetic resin and metal are used for the other portions.

The corona discharger 1 of the foregoing construction operates for discharging with the traveling member 15 in its home position, and the wire 7 is automatically cleaned by the traveling member 15 with suitable timing.

For cleaning, the motor 13 rotates forward, initiating the traveling member 15 in the initial state shown in FIG. 3 into a rightward movement, whereupon the bearing portion 18*c* leaves the land member 3*a*, permitting the tension on the drive rope 10 to push up the engaging portion 18*a* and move the support member 18 counterclockwise. This movement raises the first cleaning member 19 into pressing contact with the wire 7 and the second cleaning member 20. Consequently, the traveling member 15 moves along the wire 7, with the first and second cleaning members 19 and 20 holding the wire 7 therebetween.

Upon the traveling member 15 reaching the right end of the path of its travel, the base member 16 comes into contact with the holder 4 and is thereby halted. The resulting increase in the load current through the motor 13 is detected to reverse the direction of rotation of the motor 13, whereby the traveling member 15 is returned to the home position.

With the corona discharger 1 described above, the wire 7 can therefore be cleaned automatically to remove the deposit thereon, so that the discharger 1 is easy to maintain. Since the first and second cleaning members 19, 20 move along the wire 7 which is held therebetween, the deposit can be removed from the wire 7 effectively and reliably. While the corona discharger 1 is in operation for discharging, the traveling member 15 is in the home position, and the wire 7 is away from the first and second cleaning members 19, 20 and held in position accurately. This enables the wire 7 to effect corona discharge free of any trouble.

The driven pulley 9 is pulled by the tension spring 14 to utilize the resulting tension on the drive rope 10 for pressing the first cleaning member 19 against the wire 7. With this arrangement, the tension spring 14 can be elongated to give a greater travel stroke length to the first cleaning member 19, whereby the first cleaning member 19 can be pressed into contact with the wire 7 by an increased force with higher stability. The traveling member 15 need not be provided with a spring or the like for pressing the first cleaning member 19 against the wire and is therefore compacted and simplified in construction. Since there is no need to dispose the spring or like metal part in the vicinity of the wire 7, the discharger exhibits stabilized discharging characteristics free of any adverse effect.

Next, a description will be given of a control system for controlling the cleaning operation for the corona discharger 1.

Figure 5:
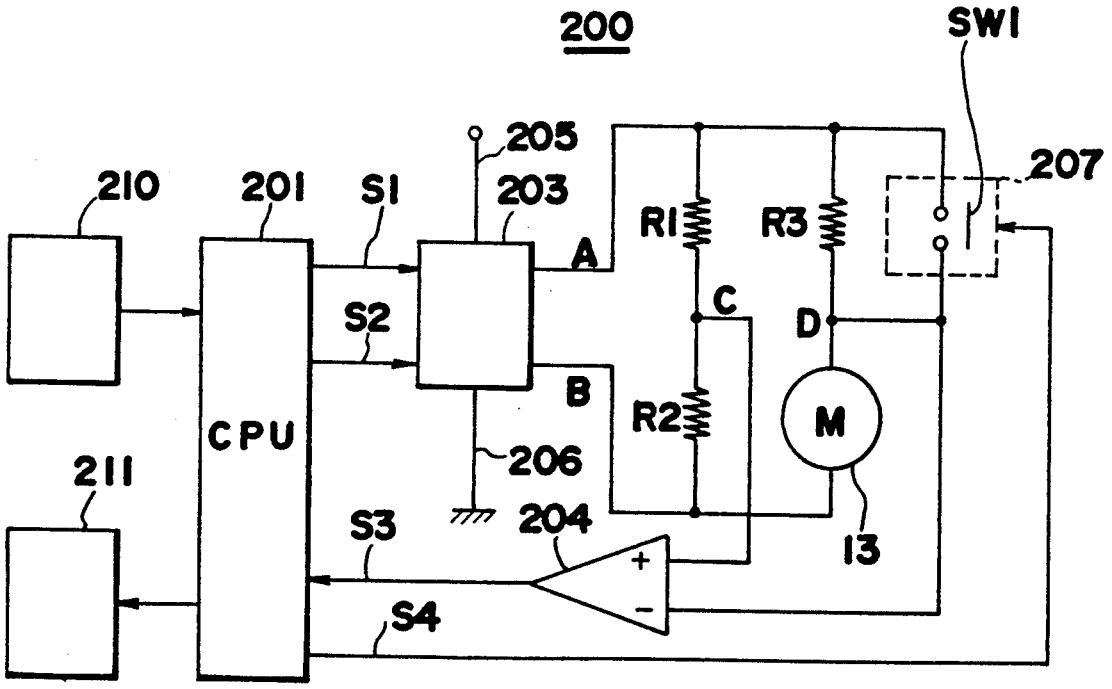
FIG. 5 is a block diagram schematically showing the construction of the control system of a copying

FIG. 5 is a block diagram schematically showing the construction of the control system 200 of a copying machine incorporating the corona discharger 1 as a sensitizing charger.

The construction of the copying machine and that of the control means for effecting a copying operation are already known and will accordingly be described briefly or will not be described.

Indicated at 201 is a CPU (central processing unit) having stored therein a program according to which the intermittent rotation of the motor 13 and the overall operation of the copying machine are to be controlled.

A change-over unit 203 is adapted to connect a d.c. 24-volt power supply line 205 and a ground wire 206 selectively interchangeably to terminals A and B in response to a forward rotation signal S1 or reverse rotation signal S2. For forward rotation, voltage of +24 volts is applied to the terminal A, and for reverse rotation, +24 volts is applied to the terminal B.

Connected to the terminals A, B is a bridge circuit composed of resistors R1, R2, R3 and the internal resistance Rm of the motor 13. Other terminals C, D are connected to the input terminals of a voltage comparator 204. The comparator 204 feeds an output signal S3 to the CPU 201 for the CPU to detect the load on the motor 13.

More specifically, the resistor R3 is set to the same resistance value as the resistance value Rmn of the motor 13 in steady-state operation. Usually, one-half (12 volts) the voltage (24 volts) delivered from the change-over unit 203 is applied to the motor 13, and the potential Vd at the terminal D is 12 volts. When the motor 13 is subjected to an increased load by the traveling member 15 coming into contact with the holder 3 or 4, or the bearing portion 18*c* riding onto the land member 3*a*, the resistance value Rm of the motor 13 decreases to a value Rmt which is lower than the value Rmn in steady-state operation, with the result that the potential Vd at the terminal D drops below 12 volts.

The terminal C is set by the resistors R1, R2 to a potential Vc which is lower than the potential Vd during the forward rotation of the motor 13 in the steady state but higher than the potential Vd when the motor 13 is under a load increased beyond a specified level (locked state).. These potentials Vc and Vd are compared by the comparator 204.

Accordingly, the level of the output signal S3 of the comparator 204 differs as follows.

| | | |
|---|---|---|
| Steady state | Forward rotation | "L" |
| | Reverse rotation | "H" |
| Locked state | Forward rotation | "H" |
| | Reverse rotation | "L" |

The CPU 201 recognizes that the motor 13 is in a locked state when the output signal S3 is "H" during forward rotation or is "L" during reverse rotation. The locked state recognized indicates a trouble during the travel of the traveling member 15 or the arrival of the member 15 at either end of the path of travel thereof.

A relay 207 has a contact SW1 connected in parallel with the resistor R3. The contact SW1 is closed in response to an output increase signal S4 from the CPU 201, whereby the resistor R3 is short-circuited to apply voltage of 24 volts to the motor 13, causing the motor 13 to produce an increased output.

The rated voltage of the motor 13 is 12 volts, and the drive with 24 volts is a rated condition for a short period of time. When driven with 24-volt voltage, the motor 13 affords a great drive force although small-sized.

The CPU 201 has further connected thereto other input units 210 and output units 211 necessary for the operation of the copying machine.

Next, the operation of the copying machine will be described with reference to the flow charts chiefly in connection with the rotation of the motor 13.

FIG. 6 is the main flow chart generally showing the operation of the copying machine.

When the power supply for the copying machine is turned on to start the contemplated program, the state to be described later is set to "0" for initialization, and the internal state of the CPU 201 and components of the copying machine are also initialized (step #1).

Next, an internal timer is started to determine the length of one routine on the main flow chart (step #2).

A wire cleaning routine is then performed for the corona discharger 1 (step #3).

A copying operation and other processes then follow (steps #4, 5). On completion of the operation of the internal timer, the sequence returns to step #2 (step #6).

FIGS. *7a* to *7c* are flow charts of the abovementioned wire cleaning routine.

In this routine wherein the corona discharger 1 is cleaned, an output increase signal S4 is produced to apply 24 volts to the motor 13 and give an increased drive force if the locked state remains uncancelled despite the lapse of a predetermined period of time (set by a timer A) following the start of the motor 13. This precludes faulty travel that would result from the riding of the bearing portion 18*c* on the land member 3*a* at the home position.

Accordingly, a timer A provides a sufficient time interval for the traveling member 15 to leave the land member 3*a* normally.

Further if a locked state is not brought about after the motor 13 has been driven for a specified period of time (determined by a timer B), the motor 13 is turned off and then on for an intermittent operation. In the event of slippage occurring between the drive pulley 8 and the drive rope 10, the rotation of the drive pulley 8 is thus interrupted temporarily, whereby the frictional force involved is changed to a force of static friction to effectively transmit the drive force and automatically obviate the slippage.

Accordingly, the timer B is set to a period of time sufficient for the traveling member 15 to travel between the holders 3 and 4.

In the following description, a timer C determines the duration of an increase in the drive force for the motor 13, and a timer D determines the duration of interruption of rotation of the motor 13.

The present routine is divided into branches according to the value of state.

When the power supply is brought to on-edge state with the state set to "0", the state is set to "1" (steps #101, 102). Accordingly, when the copying machine power supply is turned on, the following process is executed only once.

The contact SW1 is opened to drive the motor 13 at 12 volts when the state is "1" (step #111). The motor 13 is rotated forward in response to a forward rotation signal S1 (step #112).

For the detection of initial excessive locking, the timers A and B are started, and the state is set to "2" (steps #113–115).

When the locked state is recognized despite the completion of operation of the timer A with the state set to "2", this indicates an excessive locked state, so that the state is set to "8". If otherwise, the traveling member is in the normal state, so that the state is set to "3" (steps #121–124).

When the traveling member 15 is locked by reaching the end of the shield case 2 with the state set to "3", the situation is normal, and the state is therefore set to "4"

(step #134). If the timer B ceases from its operation before the locked state is brought about, this indicates slippage of the drive pulley 8 or the like. The state is then set to "9" (step #133). When the state is "4" to "6", the same procedure as in the above states "1" to "3" is taken for the reverse rotation of the motor 13. When the traveling member 15 has completed a round trip normally, the state is set to "7" (step #164), the motor 13 is deenergized in the state "7" (step #171), and the state is returned to "0" (step #172).

For the remedy of the excessive locked state when the state is "8", the contact SW1 is closed to drive the motor 13 at 24 volts (step #182). At the same time, the timer C is started to prescribe the duration of increase in the drive force (step #183). On completion of the timer C operation, the contact SW1 is opened (step #186). The state is set to "3" or "6" depending on whether the motor 13 is to be rotated forward or reversely (steps #188, 189).

To remedy the slippage when the state is "9", the rotation of the motor 13 is interrupted (step #192). At the same time, the timer D is started for prescribing the period of interruption (step #193). On completion of the timer D operation, the motor 13 is driven forward again (step #195), the timers A and B are restarted, and the state is set to "2" (steps #196–198).

When the state is "10", the same steps as in the state "9" are performed for the reverse rotation of the motor 13.

The deposit on the wire 7 can be automatically removed therefrom by the cleaning operation conducted according to the above flow charts, thereby obviating the need for the serviceman to clean the wire periodically. This enables the corona discharger 1, having various advantages, to exhibit stabilized characteristics to charge the photosensitive member of the copying machine to produce copy images of high quality free of irregularities.

Further if the traveling member 15 malfunctions when starting to travel or during its travel, the malfunction is automatically remedied. This precludes occurrence of various troubles and eliminates the need for maintenance, preventing a reduction in the operation efficiency of the copying machine.

Especially when slippage occurs between the drive pulley 8 and the drive rope 10, the traveling member 15 fails to reach the holder 3 or 4. This is detected from the occurrence of locked state and the timer B, whereupon the motor 13 is intermittently driven. Consequently, the drive pulley 8 is temporarily stopped to change the frictional force involved to a force of static friction, while the rise of the rope 10 off the pulley 10 or like faulty condition is remedied for the proper transmission of the drive force to the drive rope 10, whereby trouble can be avoided.

Figure 8A:
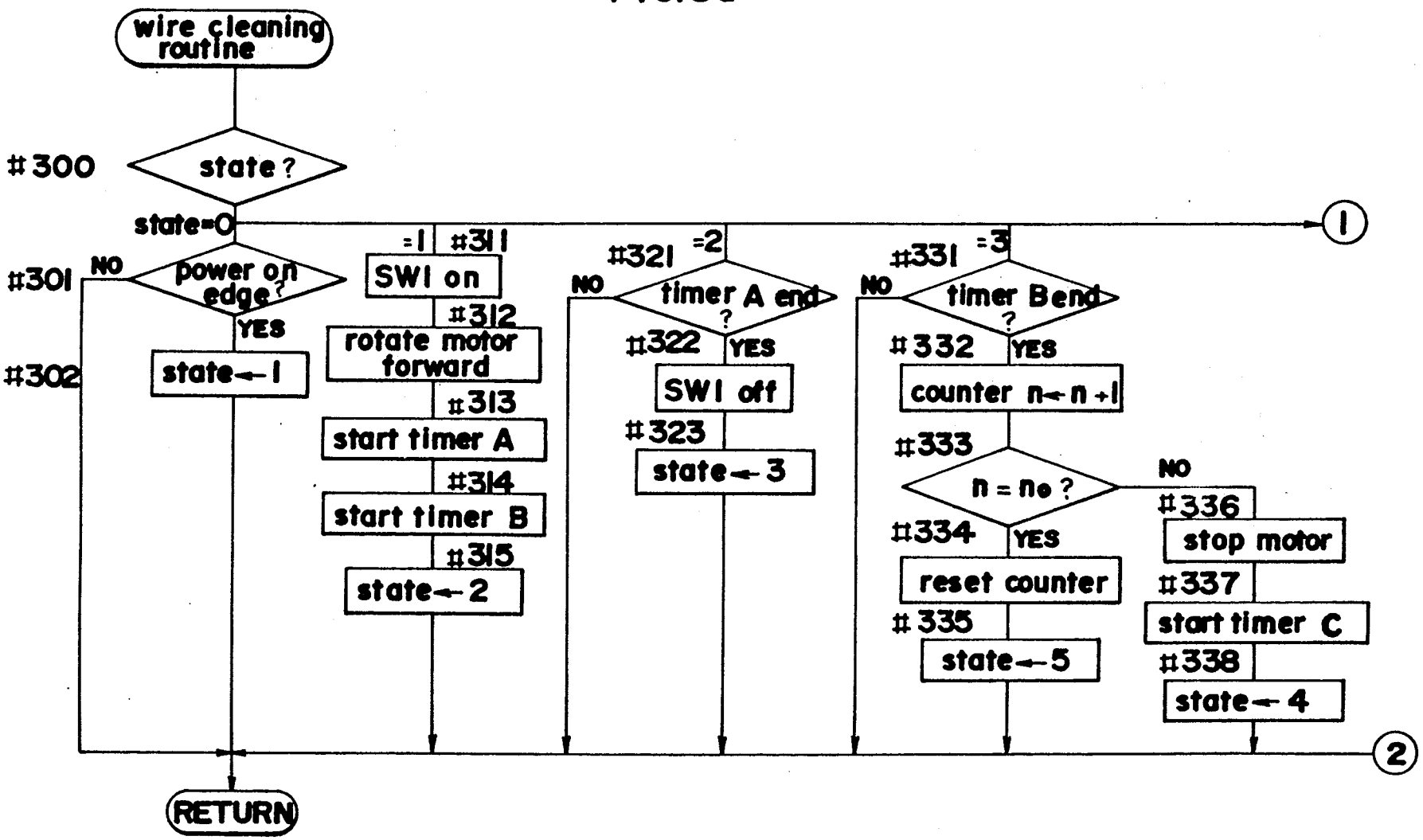
Figure 8B:
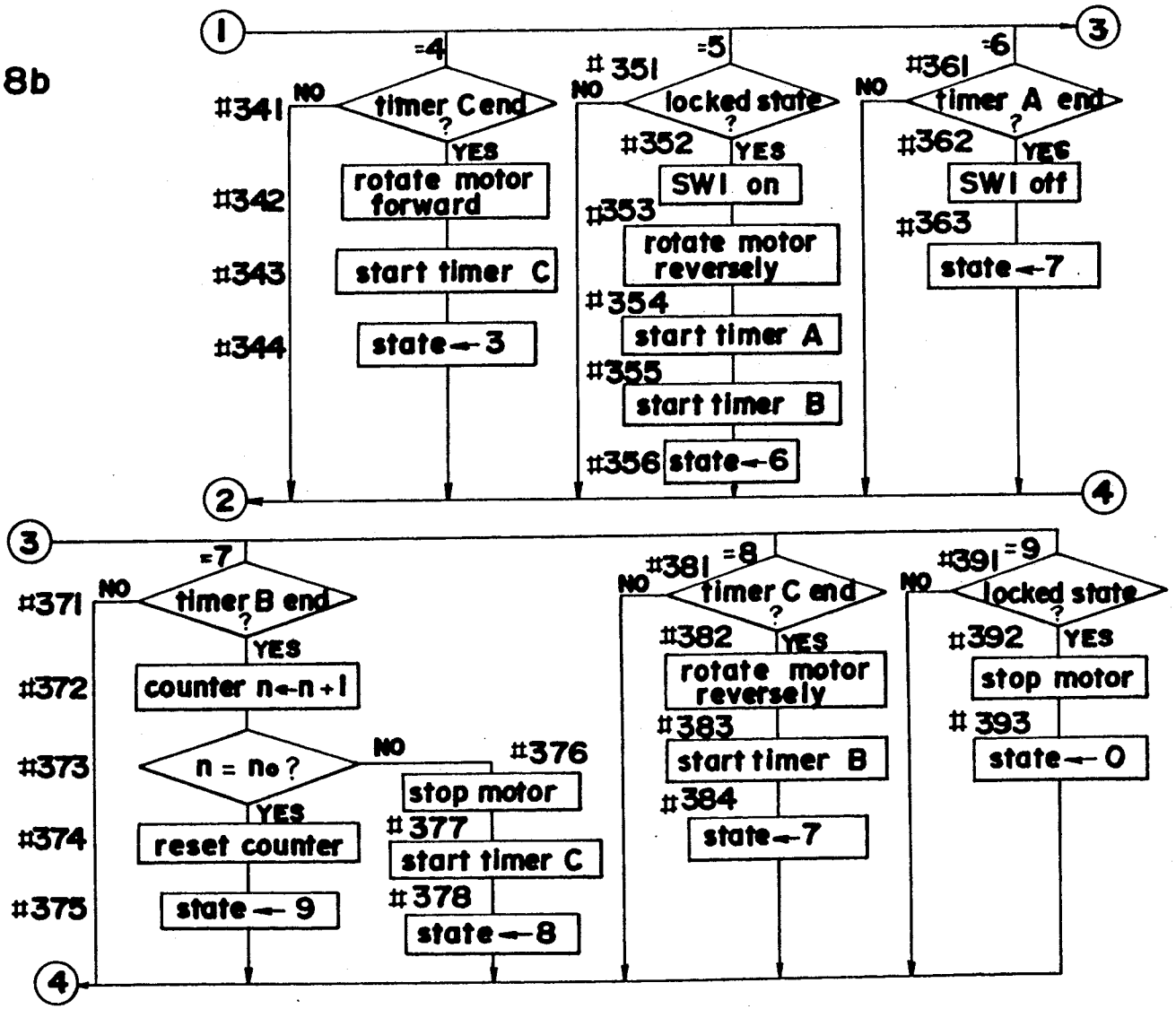

If the traveling member 15 is held locked in the home position with the bearing portion 18*c* remaining at rest on the land member 3*a*, 24 volts is applied to the motor 13 to give an increased drive force and thereby release the traveling member 15 from an excessive load which is likely to occur when it is to be brought into travel, whereby the possible trouble can be precluded. A description will be given of another wire cleaning routine embodying the invention. FIGS. 8*a* and 8*b* are flow charts showing this wire cleaning routine. With this routine, 24 volts is applied to the motor 13 only for a predetermined period of time (set by a timer A) when the motor is to be started to thereby give an increased drive force. Subsequently, the motor 13 is intermittently turned on and off n0 times. This prevents the trouble which is liable to occur when the traveling member 15 starts to travel owing to the excessive contact of the member 15 with the holder 3 or 4.

Timers B and C respectively determine the "on" interval and "off" interval of the intermittent rotation of the motor 13, while a counter counts the number of interruptions or resumptions of the rotation.

With this routine, the state is set to "1" when the power supply is on edge with the state set to "0" (steps #301, 302), followed by the procedure to be stated below.

With the state set to "1", the contact SW1 for 24-volt operation is closed (step #311), the motor 13 is driven forward, the timers A and B are started, and the state is set to "2" (steps #312–315).

When the state is "2", the contact SW1 is opened on completion of the timer A operation to resume operation at 12 volts (step #322), and the state is set to "3".

When the state is "3", the counter is advanced by an increment on completion of the timer B operation (step #332). Unless the count value is n0 (times), the motor 13 is stopped, the timer C is started, and the state is set to "4" (steps #336–338). When the count value has increased to n0 (times), the counter is reset, and the state is set to "5" (steps #334, 335).

With the state set to "4", the motor 13 is driven forward on completion of the timer C operation, the timer B is restarted, and the state is set to "3" again (steps #342–344).

When the state is set to "5", arrival of the traveling member 15 at the end of the shield case 2 is detected from the locked state recognized, and the motor 13 is driven reversely at 24 volts (steps #352, 353).

The subsequent steps in the state "5" and the steps to be performed in states "6" to "8" are the same as those in the states "1" to "4" for forward rotation.

When locking is detected with the state set to "9", the motor 13 is deenergized, whereupon the state is changed to "0" (steps #392, 393).

Figure 9A:
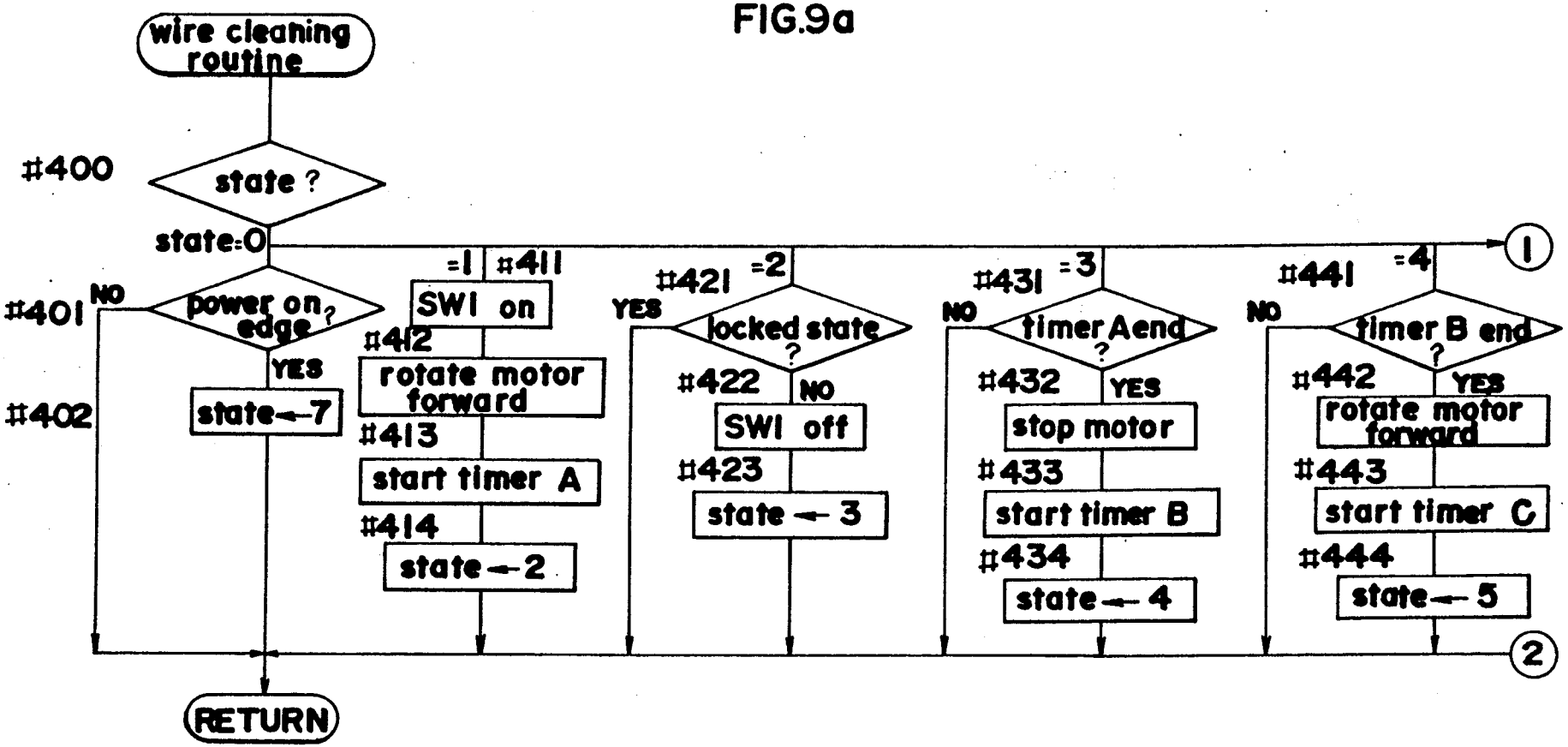
Figure 9B:
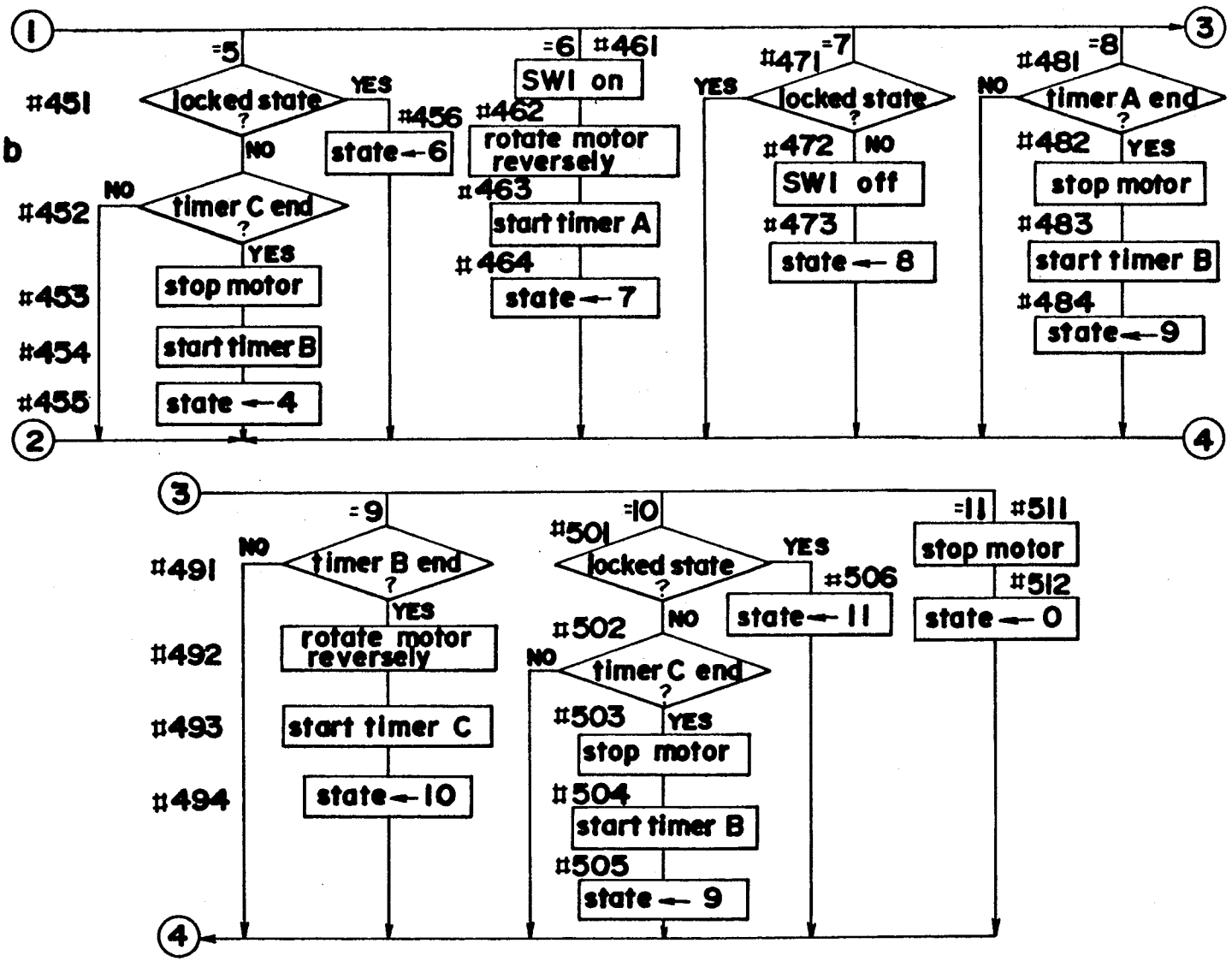

FIGS. 9*a* and 9*b* are flow charts showing another wire cleaning routine embodying the invention.

With this routine, 24 volts is applied to the motor 13 until the locked state is cancelled when the traveling member 15 is initiated into travel to thereby give an increased drive force.

If the traveling member 15 is in contact with the holder 3 or 4 to an excessive extent, the gear 11 or like drive transmission portion or the drive pulley 8 or the like will be locked to give rise to a trouble when the member 15 is to be brought into travel, whereas the above procedure precludes such a trouble. Further because the drive force is increased by the application of 24 volts only in the locked state, an adverse effect on the motor 13 and unnecessary power consumption are avoidable.

Further upon lapse of a predetermined period of time (set by a timer A) following the start of travel, the motor 13 is turned on and off intermittently n0 times to mitigate the impact to be produced when the traveling member 15 reaches the end of the path.

Timers B and C respectively determine the "off" interval and "on" interval of the intermittent rotation of the motor.

According to the present routine, the state is set to "1" when the power supply is on edge with the state set to "0" (steps #401, 402), and the sequence proceeds as follows.

With the state set to "1", the contact SW1 for 24-volt operation is closed (step #411), the motor 13 is driven forward, the timer A is started, and the state is set to "2" (steps #412–414).

When the state is "2", the motor 13 is held in operation at 24 volts until the locked state is cancelled. On cancellation of the locked state, the contact SW1 is opened for the motor to resume 12-volt operation (step #422), and the state is changed to "3".

When the state is "3", the motor 13 is stopped upon completion of the timer A operation, the timer B is started, and the state is set to "4" (steps #432–434).

When the state is "4", the motor 13 is driven forward on completion of the timer B operation, the timer C is started, and the state is set to "5" (steps #442–444).

When the state is "5", the motor 13 is temporarily stopped if the operation of the timer C is completed before the traveling member 15 reaches the end of the path, the timer B is restarted to resume the state "4", and the motor 13 is driven intermittently (steps #453–455). When the locked state is brought about upon the traveling member 15 reaching the path end, the state is set to "6" to bring the motor 13 into reverse rotation.

The steps in states "6" to "10" are the same as those in the states "1" to "5" for the forward rotation.

When the state is "11", the motor 13 is stopped, and the state is set to "0".

According to the flow charts described, the traveling member 15 is so controlled as to clean the wire 7 only once when the power supply of the copying machine is turned on, whereas the wire may be cleaned once at a given time interval or every time a specified number of copies have been made.

The first cleaning member 19 is pushed up from below according to the above embodiments but can be pressed against the wire 7 from above or sidewise. The second cleaning member 20, although fixed to the base member 16, can be made movable into pressing contact with the wire 7 like the first cleaning member 19. The drive rope 10 is in direct contact with the engaging portion 18*a*, whereas the drive rope 10 may be adapted to bias an intermediate member and push the engaging portion 18*a* indirectly through the intermediate member. The tension spring 14 may be replaced by a compression spring, plate spring or other elastic member. Two or more wires 7 may be provided.

With the foregoing embodiments, the corona discharger 1 is so constructed that the first and second cleaning members 19 and 20 are moved to clean the wire 7. Conversely, the corona discharger 50 to be described below with reference to FIGS. 10 to 13 is so designed that the wire is movable relative to fixed cleaning members.

FIG. 10 is a plan view of the corona discharger 50.

Referring to FIG. 10, a wire 51 in the form of a loop has its opposite ends connected together by a coiled spring 52 for giving suitable tension to the wire 51. The wire 51 is reeved around a driven pulley 63 and a drive pulley 67 mounted respectively on a rear holder 57 and a front holder 59 which are fixedly fitted in opposite ends of a shield case 58. The rear holder 57, the front holder 59 and the drive pulley 67 are made of an insulating material such as synthetic resin or synthetic rubber.

FIG. 11 is a front view in section of the rear holder 57, FIG. 12 is a front view in section of the driven pulley 63 provided on the rear holder 57, and FIG. 13 is a front view in section of the front holder 59.

The torque of a motor 55 is delivered to the drive pulley 67 via a worm 54 and a gear 69 on a speed reduction, and the rotation of the drive pulley 67 drives the wire 51 for travel. The drive pulley 67 is biased upward in FIG. 13 by a cushion 66 and has its level regulated by a screw 68.

The driven pulley 63 mounted on the rear holder 57 is made of metal or like conductive material. A high-voltage transformer mounted on the body of an unillustrated copying machine applies a high voltage to the wire 51 via a contact 56, a conductor 53 and the driven pulley 63.

The driven pulley 63 is biased upward in FIG. 11 by the conductor 53 which is secured to the rear holder 57 by crimping. The pulley 63 is positioned at a level adjustable with a screw 65. The drive pulley 63 and the drive pulley 67 each have a V-shaped groove so as to position the wire 51 at a specified level accurately.

The front holder 59 and the rear holder 57 are provided with cleaning members 64*a*, 64*b* of polyester film, respectively, in contact with the periphery of the wire 51. When driven, the wire 51 is cleaned with the cleaning members 64*a*, 64*b*.

When the corona discharger 50 is set in the body of the copying machine, the contact 56 and a connector 60 are joined to unillustrated respective contacts on the machine body and are connected to a control system 200.

With the corona discharger 50 described, a motor 55, when driven forward, rotates the drive pulley 67 counterclockwise in FIG. 10 to travel the wire 51 in the direction of arrow B2. The driven pulley 63 is rotated by the travel of the wire 51.

When traveling, the wire 51 passes through a cutout 73*a* formed in a front wall 73 of the rear holder 57. The travel of the wire 51 in the direction of arrow B2 brings the coiled spring 52 into contact with the front wall 73.

The motor 55, when reversely driven, moves the wire 51 and the coiled spring 52 in a direction opposite to the direction of arrow B2.

At this time, the wire 51 passes through a cutout 75*a* formed in a front wall 75 of the front holder 59 and through a cutout 74*a* in a stopper 74 provided inwardly of the wall 75. The reverse travel of the wire 51 passes the coiled spring 52 through the cutout 75*a* and thereafter brings the spring 52 into contact with the stopper 74, whereby the spring 52 is halted. The spring is accommodated inside the front holder 59.

With the corona discharger 50, like the foregoing one, two different voltages are applied to the motor 55 by the control system 200, whereby the wire can be released from an excessively loaded state due to the engagement of the coiled spring 52 with the cutout portion 73*a* or 74*a* to preclude troubles.

Although voltages of 12 volts and 24 volts are applied to the motor 13 according to the foregoing embodiments, other voltages are usable. While the voltage is thus applied to the motor 13 at two different values, the voltage may be of at least three different values, or a continuously (steplessly) varying voltage may be used.

With the foregoing embodiments, the circuit of the control system 200, the type of motor 13 or 55, and the method of controlling the operation of the motor 13, 55 can be altered variously. Furthermore, the drive pulley 8 or 67, base member 16, support member 18, first and second cleaning members 19, 20 or cleaning members 64a, 64b, land member 3a and other members are also changeable in material, configuration, construction, size, etc.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A cleaning device for wire electrode which extends linearly under tension for corona discharger comprising:

cleaning member for cleaning the wire electrode through contact therewith;

drive means for moving the wire electrode and the cleaning member relative to each other; and control means for controlling the drive means in such a manner that after activating the drive means in a direction for the cleaning operation that the drive means is momentarily deactivated and then activated in said direction again.

2. A cleaning device as claimed in claim 1, wherein said control means controls said drive means to become activated and deactivated intermittently for a predetermined period at the start of the relative movement.

3. A cleaning device as claimed in claim 1, further comprising trouble detecting means for detecting trouble of the movement by the drive means, wherein said control means controls said drive means to be temporarily deactivated and then be activated again when the trouble detecting means detects the trouble.

4. A cleaning device as claimed in claim 3, wherein said trouble is slippage in transmission of driving force generating by the driving means to the cleaning member or to the wire electrode.

5. A cleaning device as claimed in claim 3, further comprising a main casing for supporting the wire electrode, a pair of pulleys disposed at the respective ends of the main casing, and a drive wire reeved around the pair of pulleys, said cleaning member being attached to the drive wire, wherein the drive means drives one of the pulleys, and said trouble detecting means detects slip between the drive wire and the pulley driven by the driving means as the trouble.

6. A cleaning device as claimed in claim 1, further comprising a pair of pulleys, and said wire electrode is reeved around the pair of pulleys, and said driving means drives one of the pulleys.

7. A cleaning device as claimed in claim 6, further comprising trouble detecting means for detecting trouble of the movement of the wire electrode by the drive means, wherein said control means controls said drive means to be temporarily deactivated and then be activated again when the trouble detecting means detects the trouble.

8. A cleaning device as claimed in claim 7, wherein said trouble is slippage between said wire electrode and the pulley driven by said drive means.

9. A cleaning device as claimed in claim 1, further comprising detecting means for detecting positional relationship between the wire electrode and the cleaning member, and said control means controls said drive means to be temporarily deactivated when a predetermined time has passed from an activating of the drive means without detection of predetermined positional relationship by the detecting means.

10. A cleaning device as claimed in claim 1, further comprising locked state detecting means for detecting locked state of said drive means, wherein said control means controls said drive means to be temporarily deactivated when predetermined time has passed from an activating of the drive means without detection of the locked state of the drive means by the locked state detecting means.

11. A cleaning device as claimed in claim 10, further comprising a main casing for supporting the wire electrode, a pair of pulleys disposed at the respective ends of the main casing, and a drive rope reeved around the pair of pulleys, said cleaning member being attached to the drive rope.

12. A corona discharger claimed in claim 11, wherein said predetermined time is longer than time which the cleaning member takes to move from one end of an effective portion of the wire electrode to other end of the portion.

13. A cleaning device as claimed in claim 12, wherein said drive means includes an electric motor, and said locked state detecting means includes means for detecting resistance value of the electric motor.

14. A corona discharger comprising:

wire electrode extending straight for effecting corona discharge;

cleaning member for cleaning the wire electrode;

drive means for moving the wire electrode and the cleaning member relative to each other; and driving force changing means for changing driving force of the drive means during operation of the drive means.

15. A corona discharger claimed in claim 14, further comprising control means for controlling the driving force changing means so that the drive means operates in a higher driving force at a beginning of the operation of the driving means, and subsequently operates in a lower driving force.

16. A corona discharger as claimed in claim 14, wherein said control means controls the driving force changing means so that the drive means operates in a higher driving force for predetermined time after a beginning of the operation and subsequently operates in a lower driving force.

17. A corona discharger claimed in claim 15, further comprising means for detecting whether the drive means is being driven and causing said control means to control the driving force changing means to operate the drive means in a higher driving force till the driving of the drive means is detected.

18. A corona discharger claimed in claim 15, wherein said drive means including an electric motor, and said higher driving force is higher than the rated torque of the motor.

19. A corona discharger claimed in claim 14, further comprising trouble detecting means for detecting trouble of the movement by the drive means and control means for controlling said driving force changing means to increase the driving force of the driving means.

20. A corona discharger comprising:

wire electrode extending straight for effecting corona discharge;

cleaning member for cleaning the wire electrode is contact with the wire electrode;

drive means for moving the wire electrode and the cleaning member relative to each other, the driving means includes an electric motor and power supply means for applying voltage to the motor;

rotation detecting means for detecting whether the motor is rotating or not; and control means for enabling the power supply means to apply voltage of first level to the motor at a beginning of the applying voltage, and to temporarily apply voltage of second level which is higher than the first level when the rotation detecting means detects that the motor is not rotating after predetermined time has passed since the beginning of the applying voltage.

21. A corona discharger claimed in claim 20, wherein said second level is higher than the rated voltage of the motor.

22. A corona discharger claimed in claim 21, further comprising a pair of pulleys one of which is driven by the motor and a drive rope reeved around the pair of pulleys, wherein said cleaning member is attached to the drive rope.

23. A corona discharger comprising:

wire electrode extending straight for effecting corona discharge;

cleaning member for cleaning the wire electrode in contact with the wire electrode;

drive means for moving the wire electrode and the cleaning member relative to each other;

slip detecting means for detecting slippage in transmission of driving force generated by the driving means to the cleaning member or to the wire electrode;

locked state detecting means for detecting locked state of said drive means; and control means for controlling said drive means to temporarily stop the drive means and start it again when the slip detecting means detects the slippage, and to temporarily increase driving force of the drive means when the locked state detecting means detects the locked state of the drive means.

24. A corona discharger comprising:

wire electrode extending straight for effecting corona discharge;

cleaning member for cleaning the wire electrode in contact with the wire electrode;

drive means for moving the wire electrode and the cleaning member relative to each other;

locked state detecting means for detecting locked state of said drive means; and control means for, when the locked state detecting means detects the locked state of the drive means after first predetermined time has passed from a beginning of the working of the drive means, controlling said drive means to temporarily increase driving force of the drive means, and said control means controlling the drive means to temporarily stop working of the drive means and start it again when second predetermined time which is longer than the first predetermined time has passed since the beginning of the working of the drive means without detection of the locked state of the drive means by the locked state detecting means.

25. A cleaning device as claimed in claim 24, further comprising a main casing for supporting the wire electrode, a pair of pulleys disposed at the respective ends of the main casing, and a drive rope reeved around the pair of pulleys, said cleaning member being attached to the drive rope.

26. A corona discharger claimed in claim 25, wherein said second predetermined time is longer than time which the cleaning member takes to move from one end of an effective portion of the wire electrode to other end of the portion.

27. A method for cleaning wire electrode of corona discharger which has wire electrode extending straight for effecting corona discharge, cleaning member for cleaning the wire electrode in contact with the wire electrode, and drive means for moving the wire electrode and the cleaning member relative to each other, comprising the steps of:

A. starting the drive means in one direction for the cleaning operation;

B. deactivating the drive means temporarily when predetermined time has passed from the starting of the drive means; and C. activating the drive means in said direction again.

28. A method for cleaning wire electrode of corona discharger which has wire electrode extending straight for effecting corona discharge, cleaning member for cleaning the wire electrode in contact with the wire electrode, and drive means for moving the wire electrode and the cleaning member relative to each other, comprising the steps of:

A. enabling the drive means to begin to work in first driving force; and

B. changing the driving force of the drive motor to second driving force lower than the first driving force when predetermined time has passed since the beginning of the working of the drive means.

29. A cleaning device for wire electrode of corona discharger comprising:

a main casing for supporting a wire electrode extending straight for effecting corona discharge;

a pair of pulleys provided on the main casing, a drive rope reeved around the pair of pulleys;

traveling member connected to the drive rope;

drive means for driving the one of the pulleys so as to move the traveling member along the wire electrode;

support member connected to the traveling member and pivotally movable about a pivot;

first cleaning member attached to the support member and movable into pressing contact with the wire electrode by the pivotal movement of the support member; and second cleaning member secured to the traveling member and opposed to the first cleaning member with the wire electrode positioned between the first and second cleaning members;

the support member being pivotally movable by the tension on the drive rope, whereby the first cleaning member is pressed into contact with the wire electrode for the first and second cleaning members to hold the wire electrode therebetween.

30. A cleaning device as claimed in claim 29, wherein said support member contacts with the drive rope, whereby the drive rope gives the support member with force which urges the first cleaning member to press into contact with the wire electrode when the drive means drives the pulley.

31. A cleaning device as claimed in claim 30, further comprising separating member provided on the main casing for urging the first member to separate from the wire electrode and the second cleaning member caused by contact with the support member when the traveling member is positioned at the end of an extent in which the traveling member is movable.

* * * * *

UNITED STATES PATENT AND TRADEMARK OFFICE

CERTIFICATE OF CORRECTION

PATENT NO. : 5,012,093

DATED : April 30, 1991

INVENTOR(S) : Tadafumi Shimizu

It is certified that error appears in the above-identified patent and that said Letters Patent is hereby corrected as shown below:

In col. 4, line 4, after "copying", insert --machine;--.

In col. 8, line 26, change "a" (first occurrence) to --the--.

In col. 13, line 37 (claim 4, line 3), change "generating" to --generated--.

In col. 15, line 1 (claim 20, line 4), change "is" to --in--.

In the Abstract paragraph, line 2 thereof, change "electrophoographic" to --electrophotographic--.

Signed and Sealed this

Fifteenth Day of September, 1992

*Attest:*

*Attesting Officer*

DOUGLAS B. COMER

*Acting Commissioner of Patents and Trademarks*